US010703982B2

(12) United States Patent
Wu et al.

(10) Patent No.: US 10,703,982 B2
(45) Date of Patent: Jul. 7, 2020

(54) PROCESS FOR SOLVENT EXTRACTION OF OIL SAND BITUMEN

(71) Applicant: SYNCRUDE CANADA LTD. in trust for the owners of the Syncrude Project as such owners exist now and in the future, Fort McMurray (CA)

(72) Inventors: Xin Alex Wu, Edmonton (CA); Sujit Bhattacharya, Edmonton (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 254 days.

(21) Appl. No.: 15/820,143

(22) Filed: Nov. 21, 2017

(65) Prior Publication Data

US 2019/0153326 A1 May 23, 2019

(51) Int. Cl.

| | |
|---|---|
| ***C10G 1/04*** | (2006.01) |
| ***B01F 3/12*** | (2006.01) |
| ***B01F 7/22*** | (2006.01) |
| ***B01F 15/00*** | (2006.01) |

(52) U.S. Cl.

CPC ..... *C10G 1/045* (2013.01); *B01F 3/1221* (2013.01); *B01F 3/1271* (2013.01); *B01F 7/22* (2013.01); *B01F 15/00883* (2013.01); *B01F 2215/0063* (2013.01); *B01F 2215/0083* (2013.01); *B01F 2215/0422* (2013.01); *B01F 2215/0431* (2013.01); *C10G 2300/44* (2013.01)

(58) Field of Classification Search

None

See application file for complete search history.

(56) References Cited

U.S. PATENT DOCUMENTS

| | | | | |
|---|---|---|---|---|
| 4,719,008 | A | 1/1988 | Sparks et al. | |
| 2012/0048781 | A1* | 3/2012 | Wu | C10G 1/045 208/390 |

FOREIGN PATENT DOCUMENTS

| | | |
|---|---|---|
| CA | 2740468 A1 | 11/2012 |
| CA | 2895118 A1 | 12/2016 |

* cited by examiner

*Primary Examiner* — Derek N Mueller

(74) *Attorney, Agent, or Firm* — Bennett Jones LLP

(57) ABSTRACT

A process for solvent extraction of bitumen from mined oil sand ore is provided, comprising mixing the mined oil sand ore with at least one solvent to produce a solvent/oil sand slurry; adding water to the solvent/oil sand slurry to produce a slurry having a water-to-solids mass ratio of less than about 0.1; mixing the slurry in a mixing tank having a diameter to agglomerate the solids present in the slurry, the mixing tank operating at a power input of between 20 and 50 W/kg of slurry, to produce an agglomerated slurry; and subjecting the agglomerated slurry to solid-liquid separation to produce a first liquids stream containing bitumen and a first solids stream; whereby the slurry height in the mixing tank is 0.1 to 0.3 of the tank diameter.

11 Claims, 2 Drawing Sheets

H/T = 0.1-0.3
D/T = 0.5-0.75
C/T = 0.005-0.05

H/T = 0.1-0.3
D/T = 0.5-0.75
C/T = 0.005-0.05

PROCESS FOR SOLVENT EXTRACTION OF OIL SAND BITUMEN

FIELD OF THE INVENTION

The present invention relates to a process and apparatus for solvent extraction of bitumen from mined oil sand ore. In particular, the present invention relates to solvent extraction of bitumen with improved solids agglomeration. Water is used as a bridging agent such that subsequent solid-liquid separation by filtration is sufficiently fast to support high throughput.

BACKGROUND OF THE INVENTION

The present commercial bitumen extraction process for mined oil sands is Clark hot water extraction technology or its variants that use large amounts of water and generate a great quantity of wet tailings. Part of the wet tailings becomes fluid fine tailings (FFT), which contain approximately 30% fine solids and are a great challenge for tailings treatment. In addition, certain "problem" oil sands, often having high fines content, yield low bitumen recoveries in the water-based extraction process. This leads to economic losses and environmental issues with bitumen in wet tailings.

An alternative to water-based extraction is solvent extraction of bitumen from mined oil sands, which uses little or no water, generates no wet tailings, and can potentially achieve higher bitumen recovery than the existing water-based extraction, especially from the aforementioned problem oil sands. Therefore, solvent extraction is potentially more robust and more environmentally friendly than water-based extraction.

One key challenge of solvent extraction processes is to promote flocculation/agglomeration of oil sand solids with an added bridging liquid (e.g., water) for fast filtration rates while maintaining the total water content in solids low enough for subsequent solids drying and solvent recovery. In general, flocculation requires lower water addition and generates smaller aggregates (flocs or microagglomerates, near 0.2-0.6 mm) causing slower filtration, and agglomeration requires higher water addition and generates larger aggregates (agglomerates, near 1 mm or larger) causing faster filtration. This is because agglomerates generally require more bridging liquid (water) to fill their pores while flocs require less bridging liquid (water). Since most of the added water needs to be boiled off during solids drying and solvent recovery, ideally, it is desirable to generate agglomerates that allow faster filtration but with lower water addition.

Agglomeration of oil sand solids present in hydrocarbons has been discussed in the literature. In solvent extraction spherical agglomeration (SESA) process (U.S. Pat. No. 4,719,008), the water/solids (W/S) mass ratio in extracted (or spent) oil sand is in the range of 0.08-0.15 to generate "agglomerates" of a broad size range of 0.1-2 mm. In its examples (Tables IX and X of U.S. Pat. No. 4,719,008), the W/S ratio is 0.1-0.12 and the "agglomerate" size is around 0.5 mm, which indicates that they were indeed microagglomerates. The apparatus to make the microagglomerates is a horizontal tumbler with rods inside.

In a later process (CA Pat 2740468), microagglomerates of 0.1-1 mm are produced with a broad range of W/S ratio 0.02-0.25. In its example (paragraph [0095] in CA Pat 2740468), the W/S ratio is 0.11, similar to that of SESA process. The apparatus to make these microagglomerates includes all forms of agitation, e.g. mixing tanks, blenders, attrition scrubbers and tumblers. No specifics were given except that the mixing vessels must have a sufficient amount of agitation to keep the formed agglomerates in suspension.

Despite the high W/S ratio of above 0.1, the prior art methods do not appear to generate large agglomerates of near 1 mm or larger, which would be ideal for rapid and economic hydrocarbon drainage.

SUMMARY OF THE INVENTION

The present invention relates to a solvent extraction process which generates agglomerates of near 1 mm or larger. It was surprisingly discovered that using unconventional mixing conditions with a modified mixing tank for flocculating/agglomerating solids present in hydrocarbon resulted in agglomerates of about 0.9 mm (in diameter) or larger.

Broadly stated, in one aspect of the present invention, a process for extracting bitumen from mined oil sand ore is provided, comprising:

- mixing the mined oil sand ore with at least one solvent to produce a solvent/oil sand slurry;
- adding water to the solvent/oil sand slurry to give a slurry having a water-to-solids mass ratio of less than about 0.1;
- mixing the slurry in a mixing tank having a diameter to agglomerate the solids present in the slurry, the mixing tank operating at a power input of between 20 and 50 W/kg of slurry, to produce an agglomerated slurry; and
- subjecting the agglomerated slurry to solid-liquid separation to produce a first liquids stream containing bitumen and a first solids stream;

whereby the slurry height in the mixing tank is 0.1 to 0.3 of the tank diameter.

In one embodiment, the process further comprises washing the first solids stream with solvent and subjecting the solids and solvent to solid-liquid separation to produce a second liquids stream and a second solids stream.

In one embodiment, the solvent is a mixture of a high-flash point heavy solvent (HS) and a light solvent (LS). In one embodiment, the mass ratio of HS/LS is controlled to be in the range of about 75/25 to about 40/60 to ensure little to no asphaltene precipitation.

The heavy solvent may be a light gas oil stream, i.e. a distillation fraction of oil sand bitumen, of mixed $C_9$ to $C_{32}$ hydrocarbons with a boiling range within about 130-470° C. The light end boiling is below about 170° C. The contaminant content originating from a naphtha stream in the upgrader is less than about 5 wt %. It has a flash point of about 90° C. in air. The light solvent may be a mixed aliphatic and aromatic hydrocarbon stream $C_6$-$C_{10}$ with a boiling range of 69-170° C., which light solvent is available from bitumen upgrading units. The preferred LS is $C_6$-$C_7$ with a boiling range of 69-110° C.

In one embodiment, the solvent is a light solvent only. It is a mixed aliphatic and aromatic hydrocarbon stream $C_6$-$C_{10}$ with a boiling range of 69-170° C.

In one embodiment, solids aggregation is conducted using a baffled tank agitated with one or more impellers mounted vertically with a bottom clearance of between 0.005-0.05 of the tank diameter.

Water is added to the tank to give a total water to solids (W/S) mass ratio of less than about 0.1. In another embodiment, the water to solids mass ratio is less than 0.09. In one embodiment, the one or more impellers each comprises 45° pitched blade turbines (PBT) having a diameter ranging from about 0.5 to about 0.75 of the tank diameter. In one embodiment, the power input by the one or more impellers preferably ranges from about 25 to about 40 W/kg of slurry.

In another aspect, a mixing apparatus for agglomerating solids present in a solvent/oil sand slurry is provided, comprising:

a tank having a top, a bottom, and a diameter, the tank comprising at least one vertical baffle, a slurry outlet, and a slurry inlet; and at least one vertical impeller mounted in the tank, the at least one impeller having a diameter of 0.5 to 0.75 of the tank diameter and are mounted such that a bottom clearance is 0.005 to 0.05 of the tank diameter, and the at least one impeller having a power input of 20 to 50 W/kg of slurry;

whereby, in operation, the slurry height is 0.1 to 0.3 of the tank diameter. In one embodiment, the power input is 25 to 40 W/kg of slurry.

In one embodiment, the slurry height in the tank is 0.1 to 0.3 of the tank diameter. In another embodiment, the at least one impeller comprises 45° pitched blade turbines. In one embodiment, the slurry outlet is at the bottom of the tank. In one embodiment, the slurry inlet is near the top of the tank. In one embodiment, the slurry outlet is positioned near the surface of the slurry layer. In one embodiment, the tank comprises one to four vertical baffles.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

The detailed description set forth below in connection with the appended drawings is intended as a description of various embodiments of the present invention and is not intended to represent the only embodiments contemplated by the inventors. The detailed description includes specific details for the purpose of providing a comprehensive understanding of the present invention. However, it will be apparent to those skilled in the art that the present invention may be practised without these specific details.

The present invention relates generally to a solvent extraction process and apparatus for extracting bitumen from mined oil sand ore with improved solids agglomeration. It was surprisingly discovered that the present invention produces a drastically different solid product. In particular, a slurry mixing tank is provided that can operate under non-conventional conditions, for example, at high power input and at a slurry height that is only 0.1 to 0.3 of the tank diameter. The mixing tank produces oil sand solid agglomerates of near 1 mm in diameter or larger in hydrocarbon mixture.

It was further discovered that the formation of these large agglomerates can occur at a relatively low bridge liquid (water) content, e.g., at a water to solids (W/S) ratio of about 0.09 in slurry. By comparison, higher W/S of 0.1-0.12 used in the processes of prior art (U.S. Pat. No. 4,719,008 and CA Pat 2740468) only produced microagglomerates of around 0.5 mm in diameter.

Without being bound to theory, the mechanism of forming the large agglomerates may be related to the disruption of large slurry circulation loops in the mixing tank due to the reduced slurry height. Instead, the slurry circulation loops become smaller and more numerous. Combined with higher impeller speed (or energy input), the collision rate between solid particles greatly increases causing larger agglomerates to form. These low-water-content agglomerates offer a unique opportunity of extracting oil sand bitumen with hydrocarbon solvents at a faster filtration rate without significant increase of the energy input in the final solids drying step that boils water off the solids.

Figure 1:
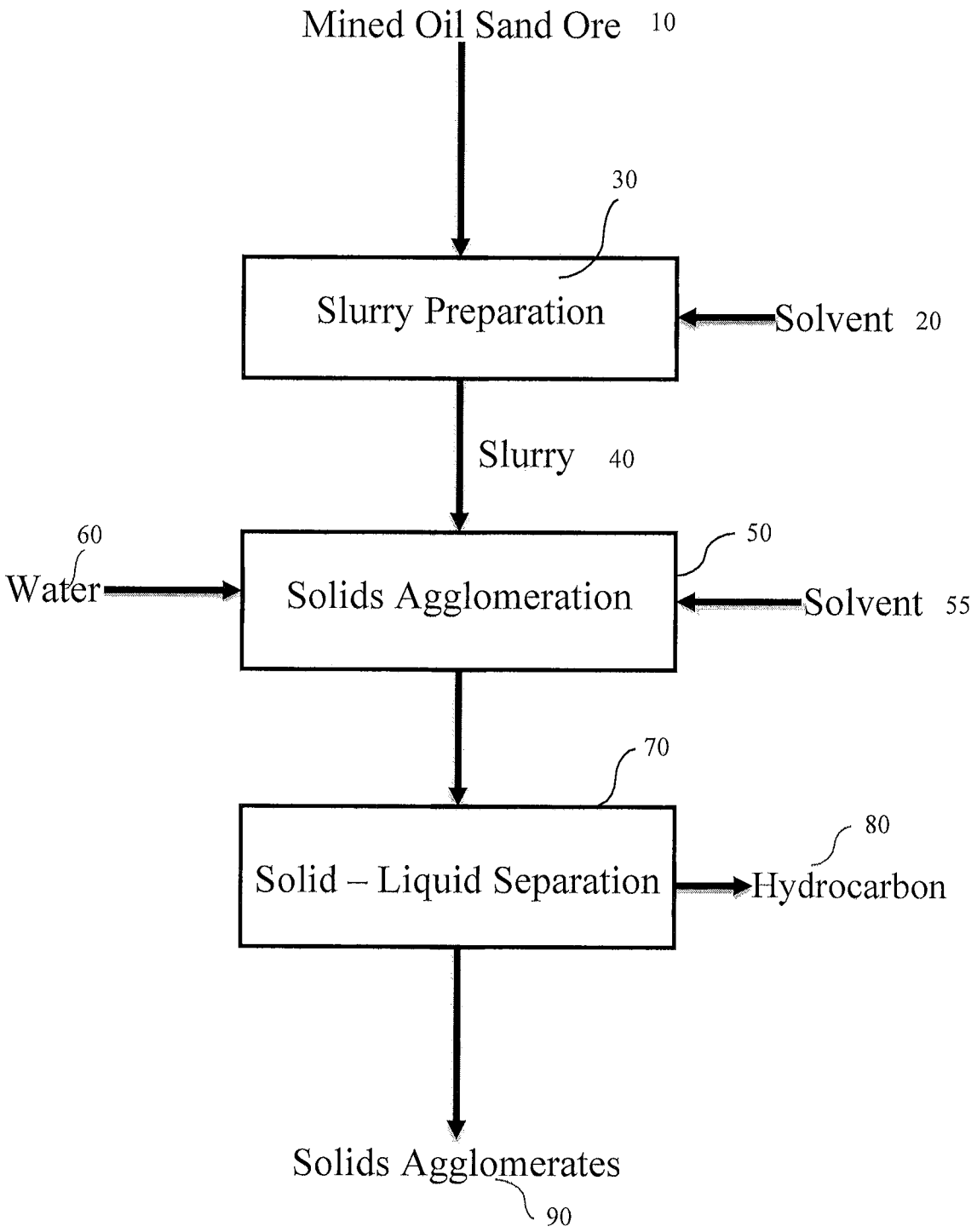
FIG. 1 is a schematic process flow diagram of a solvent extraction process of the present invention.

With reference now to FIG. 1, as mined oil sand ore 10 is mixed with hot solvent 20 in a slurry preparation and conditioning unit 30 to form a solvent/oil sand slurry. The unit may comprise a rotating tumbler followed by a two-stage sizer/crusher. Longitudinal lifters may be present in the tumbler to assist in the comminution of large oil sand lumps by lifting and dropping them on other oil sand lumps. The solids content in the solvent/oil sand slurry is about 60-75 wt % and the bitumen concentration is generally about 50 wt %. The slurry temperature is preferably around 50° C. In one embodiment, the source of heat comes primarily from the hot solvent. In one embodiment, the solvent used is a mixture of a HS and bitumen.

The slurry stream 40 is then subjected to a solids agglomeration step 50, where water is added to the slurry to aggregate the fines with sand grains. This minimizes the fines liberation into the hydrocarbon phase. A solvent stream 55 may also be added to facilitate mixing and aggregation. In one embodiment, the solvent used is a mixture of a HS and an LS. The aggregation of fines with sand grains forms agglomerates of near 1 mm or larger which are characterized as having a funicular structure with a greater amount of water molecules filling the spaces among the solids, and more securely bridging the solids together. The percentage of pore filling by the bridging water ranges from about 45% to about 95%.

Figure 2:
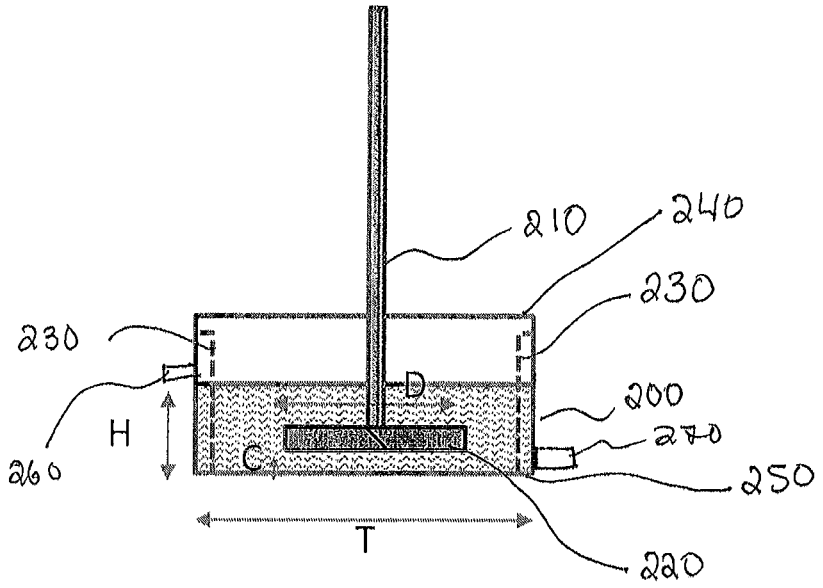
FIG. 2 is a schematic diagram of a baffled tank agitated with impellers useful in the present invention.

The solids agglomeration step 50 may use a static or dynamic mixer which can input power of 20-50 W/kg of slurry. The impeller can operate in either a down-pumping mode or an up-pumping mode. Preferably, the mixer is a tank 200 agitated with at least one impeller 210, as shown in FIG. 2. Tank 200 has a top 240, a bottom 250, a slurry inlet 260, a slurry outlet 270 and a diameter (T). Tank 200 further comprises baffles 230. The impeller 210 comprises a plurality of impeller blades 220, which impeller blades have a diameter (D) that is 0.5-0.75 of the tank diameter (T). The bottom clearance (C) of impeller 210 is 0.005-0.05 of the tank diameter (T).

In operation, the slurry height (H) in tank 200 is 0.1-0.3 of the tank diameter (T). The power input by impeller 210 is 20-50 W/kg of slurry. Such a tank as shown in FIG. 2 differs from the one proposed in CA Pat 2895118 in that, in operation, the slurry height (H/T 0.1-0.3) is significantly reduced. Further, the power input is significantly increased, i.e., from 1-15 W/kg of slurry in CA Pat 2895118 to 20-50 W/kg of slurry in the present invention. The conditions of H/T~1 and the lower power input are the conventional mixing conditions used in various industries. These conventional conditions are sufficient to keep oil sand solids suspended in hydrocarbon mixture, but not sufficient to make large agglomerates as described.

After solids agglomeration 50 in a mixer such as mixing tank 200, the slurry is then subjected to solid-liquid separation, for example, using filtration, to produce a hydrocarbon product 80 and solids agglomerates 90. In some embodiments, the solids agglomerates from the separator may be washed and subjected to a second-stage solid-liquid separation to generate a second solids stream for drying in a solids dryer.

Example 1

An oil sand ore was used in the following example which contained 8.9 wt % bitumen, 4.2 wt % water and 86.9 wt % solids. The fines (<44 μm) content in the solids was 45 wt %. The added water came from an oil sand tailings pond with pH 8.5. The hydrocarbon phase in the slurry prior to the first filtration step comprised about 33 wt % bitumen, 34 wt % virgin light gas oil and 33 wt % heptane. The solids content in the slurry was about 52 wt %. The solids were agglomerated in a continuous mixing tank of 40 cm in diameter (T) at about 50° C. The impeller was a 4-blade 45° PBT of 25.4 cm in diameter (D). The bottom clearance (C) was about 1 cm. The approximate slurry height was 6 cm. Thus, D/T=0.64, C/T=0.025 and H/T=0.15. The impeller was turned to pump down at 175 rpm in test #1 and at 295 rpm in test #2. The impeller power inputs were estimated to be 8 W/kg of slurry and 37 W/kg of slurry in tests #1 and #2, respectively. The W/S mass ratios in tests #1 and #2 were 0.099 and 0.088, respectively. The mixed slurry was transferred to a top-loading continuous pan filter with about −1 kPa g pressure (very weak vacuum) inside its filtrate receivers. The cake thickness was about 2.5 cm.

The results are shown in Table 1 below. Table 1 shows that with the same low value of H/T, only the high power input case produced the large agglomerates. The advantage of filtering the large agglomerates is shown clearly by the higher filtrate rate.

TABLE 1

Agglomeration Results of Test #1 and Test #2

| Test No. | H/T | Energy Input (W/kg) | W/S | Agglomerate size (mm) | First filtrate rate ($L/m^2$ s) |
|---|---|---|---|---|---|
| #1 | 0.15 | 8 | 0.099 | 0.2-0.5 | 1.15 |
| #2 | 0.15 | 37 | 0.088 | 0.9-1.5 | 2.52 |

Example 2

The same type of oil sand and similar slurry compositions were used in this example. In test #3, the same mixing tank as in tests #1 and #2 was used. The H/T was about 0.15. The impeller speed was 270 rpm, giving approximately 29 W/kg of slurry energy input. The W/S ratio in the slurry was 0.09. In test #4, a batch dished-bottom mixing tank of 13 cm in diameter (T) was used. The impeller was a 6-blade 45° PBT of 7.6 cm in diameter (D). The bottom clearance (C) was about 0.5 cm. The approximate slurry height was 6.7 cm. Thus, D/T=0.58, C/T=0.038 and H/T=0.52. The impeller speed was 1050 rpm, giving approximately 33 W/kg of slurry energy input. The mixing time was 4 min, similar to the residence time in the continuous mixer of test #3.

TABLE 2

Agglomeration Results of Test #3 and Test #4

| Test No. | H/T | Energy Input (W/kg) | W/S | Agglomerate size (mm) |
|---|---|---|---|---|
| #3 | 0.15 | 29 | 0.090 | 0.9-1.5 |
| #4 | 0.52 | 33 | 0.092 | 0.2-0.5 |

The results in Table 2 indicate that, with a similarly high energy input, only the low HIT case (H/T=0.15) produced the large agglomerates.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A process for solvent extraction of bitumen from mined oil sand ore, comprising:

(a) mixing the mined oil sand ore with at least one solvent to produce a solvent/oil sand slurry;

(b) adding water to the solvent/oil sand slurry to produce a slurry having a water-to-solids mass ratio of less than about 0.1;

(c) mixing the slurry in a mixing tank having a diameter to agglomerate the solids present in the slurry, the mixing tank operating at a power input of between 20 and 50 W/kg of slurry, to produce an agglomerated slurry; and (d) subjecting the agglomerated slurry to solid-liquid separation to produce a first liquids stream containing bitumen and a first solids stream;

whereby the slurry height in the mixing tank is 0.1 to 0.3 of the tank diameter.

2. The process as claimed in claim 1, further comprising:

(e) washing the first solids stream with solvent and subjecting the first solids stream to solid-liquid separation to produce a second liquids stream and a second solids stream.

3. The process as claimed in claim 1, wherein the solvent is a mixture of a high-flash point heavy solvent (HS) and a light solvent (LS).

4. The process as claimed in claim 3, wherein the mass ratio of HS/LS is in the range of about 75/25 to about 40/60.

5. The process as claimed in claim 3, wherein the HS is a light gas oil stream and the LS is a $C_6$-$C_{10}$ hydrocarbon.

6. The process as claimed in claim 1, wherein the mixing tank is a baffled tank agitated with one or more impellers mounted vertically in the tank.

7. The process as claimed in claim 6, wherein at least one impeller has a bottom clearance of between 0.005-0.05 of the tank diameter.

8. The process as claimed in claim 1, wherein water is added to the tank to give a total water to solids (W/S) mass ratio of less than about 0.1.

9. The process as claimed in claim 1, wherein water is added to the tank to give a total water to solids mass ratio of less than 0.09.

10. The process as claimed in claim 1, wherein the power input is by means of one or more impellers and the mixing tank is operating at a power input of between 25 to about 40 W/kg of slurry.

11. The process as claimed in claim 1, further comprising adding additional solvent to the slurry during mixing in the mixing tank.

* * * * *